US006460851B1

(12) United States Patent
Lee et al.

(10) Patent No.: US 6,460,851 B1
(45) Date of Patent: Oct. 8, 2002

(54) COMPUTER INTERFACE APPARATUS FOR LINKING GAMES TO PERSONAL COMPUTERS

(76) Inventors: Dennis H. Lee, 1904 Wilshire Ct., Somerville, NJ (US) 08876; Jie Huang, 438 Conover Dr., Neshanic, NJ (US) 08853

( * ) Notice: Subject to any disclaimer, the term of this patent is extended or adjusted under 35 U.S.C. 154(b) by 0 days.

(21) Appl. No.: 09/575,926

(22) Filed: May 23, 2000

Related U.S. Application Data

(63) Continuation-in-part of application No. 08/858,216, filed on May 10, 1997, now Pat. No. 6,102,397
(60) Provisional application No. 60/017,471, filed on May 10, 1996.

(51) Int. Cl.[7] ..... A63F 3/00
(52) U.S. Cl. ..... 273/238; 463/1
(58) Field of Search ..... 273/236, 237, 273/238, 239, 284, 287, 288, 242; 463/1, 9, 30, 31, 36, 37, 38, 40, 42, 43, 46

(56) References Cited

U.S. PATENT DOCUMENTS 5,190,285 A * 3/1993 Levy et al. ..... 273/85 G
5,290,038 A * 3/1994 Khin ..... 273/263
5,320,362 A * 6/1994 Bear et al. ..... 273/440
5,393,074 A * 2/1995 Bear et al. ..... 273/440
5,636,994 A * 6/1997 Tong ..... 434/308
6,167,353 A * 12/2000 Piernot et al. ..... 702/94

* cited by examiner

*Primary Examiner*—Joe H. Cheng
*Assistant Examiner*—Kim T. Nguyen
(74) *Attorney, Agent, or Firm*—LaMorte & Associates

(57) ABSTRACT

A system and method for interconnecting a computer with the physical structure of an amusement device. The interface assembly contains a plurality of play object identifiers that are capable of identifying various play objects when placed on the interface assembly. Depending upon the game or activity being played, the system may have a plurality of prop objects that are selectively positionable on the interface assembly. The prop objects are used to create an activity landscape on the interface assembly. The computer reads the configuration of the activity landscape through the interface assembly. The game or activity being played also has action objects that are selectively positionable on the interface assembly within the activity landscape, wherein interface assembly reads the position of the action objects to the computer.

14 Claims, 3 Drawing Sheets

COMPUTER INTERFACE APPARATUS FOR LINKING GAMES TO PERSONAL COMPUTERS

RELATED APPLICATIONS

This application is a Continuation-In-Part of U.S. patent application Ser. No. 08/858,216, entitled COMPUTER INTERFACE APPARATUS FOR AN AMUSEMENT DEVICE, filed May 10, 1997, now U.S. Pat. Ser. No. 6,102,297 which has the priority of Provisional Patent Application No. 60/017,471, filed May 10, 1996, entitled COMPUTER INTERACTIVE GAMEBOARD SYSTEM.

BACKGROUND OF THE INVENTION

1. Field of the Invention

In general, the present invention relates to computer interface devices that enable a user to read information to and from a computer. More specifically, the present invention relates to interface devices that enable games, toys, activity centers and other amusement devices to directly interact with a personal computer.

2. Prior Art Statement

There are many different types of computer interface devices that exist in the prior art record. The primary purpose of a computer interface device is to enable a user to enter and retrieve data from a computer. Computer interfaces typically fall into one of two categories, which are data input interfaces and data retrieval interfaces. Data input interfaces are used to enter data into a computer. The most common type of data input interface for a computer is the computer keyboard. A computer keyboard enables alphanumeric characters to be selectively entered as data into a computer. Other common types of data input interfaces for a computer include touch pads, touch screens, mice, scanners, modems and the like. Data retrieval interfaces are used to read data from a computer. The most common types of data retrieval interfaces are display screens and printers.

In the prior art there are very few computer interface devices that are specifically designed to interconnect personal computers with games, toys, activity centers and other amusement devices. Of the few computer interfaces that do exist for amusement devices, most came into existence when circuitry was added to a conventional game. Over the years, various manufacturers have added processor circuitry to the physical structure of different games so that the role of at least one player can be played by the processor circuitry. In each instance, some mechanism was developed that informs the processor circuitry about the layout of the game, the position of the game pieces and the change in those positions after each move. Such an information exchange with the processor is required if the processor circuitry is going to participate in the play of the game. For example, there are many different manufacturers that make computerized chess games. In such games, the chess board contains a plurality of electronic trigger elements that are triggered by the playing pieces. As a result, the chess board acts as a computer interface that reads to a computer the location of the playing pieces as the playing pieces are moved across the board. Another example of a game/computer interface is found in U.S. Pat. Ser. No. 5,393,074 to Bear, entitled MODULAR ELECTRONIC GAMING SYSTEM. In this patent, a computer is connected to a game board having a game path that can be custom designed. As the game path on the board is designed, the computer recognizes the pattern and directs play accordingly.

Although processor circuitry has been added to many different games, many other games have never been updated. One class of games that has typically not been updated with electronics is classic board games. Classic board games include such games as Monopoly®, Life®, Candyland®, Risk®, Scrabble® and the like. Rather than having electronics added to the structure of classic board games, classic board games have commonly been converted into software packages that can be run by a personal computer. As such, instead of processor circuity being added to the structure of the board game, the structure of the board game is converted to imagery that is reproduced on a computer screen. For example, if a player were to run a Monopoly® game program on his/her computer, the game board, playing pieces, money, cards and dice would be reproduced on the computer screen. The player would then interact with the computer using the computer keyboard or mouse. Despite how good a computer programs graphics may be, playing a game on a computer screen is rarely as good as viewing the real physical game. Similarly, clicking a mouse to move an icon on a computer screen is not as much fun as physically grasping a playing piece and moving it around a board. Another disadvantage of game software is that the screen used to display the game board is often small. It is therefore very difficult for multiple people to view the computer screen simultaneously in order to determine the position of their game pieces and the game pieces of the other players.

A need therefore exists in the art for a way to interface various physical games, activity centers and other amusement devices with a computer so that the physical structure of the game is not significantly altered, yet a computer is enabled to communicate with the structure of the game so that it can participate in the play of the game. This need is met by the present invention as described and claimed below.

SUMMARY OF THE INVENTION

The present invention is a system and method for interconnecting a computer with the physical structure of an amusement device, such as a board game, a child's activity center or a puzzle. The system utilizes a preexisting remote computer, such as a personal computer or a video game computer station. The computer is attached to an interface assembly using the connection features that exist on the computer. The interface assembly contains a plurality of play object identifiers that are capable of identifying various play objects when the play objects are placed on the interface assembly.

Depending upon the game or activity being played, the system may have a plurality of prop objects that are affixed to the interface assembly or selectively positionable on the interface assembly. The prop objects are used to create an activity landscape on the interface assembly. The computer reads the configuration of the activity landscape through the interface assembly. The game or activity being played also has action objects that are selectively positionable on the interface assembly and the prop objects within the activity landscape, wherein the interface assembly reads the position of the action objects to the computer. The activity landscape may also contain activity stations. Activity stations are places in the game where the activity landscape can be manually manipulated. At the activity stations, the movement of activity landscape is read by the computer.

By reading the activity landscape, the movement of play objects and the movements at activity stations, a computer can interact in play by taking the part of a player or prompting a story line that promotes play.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Figure 1:
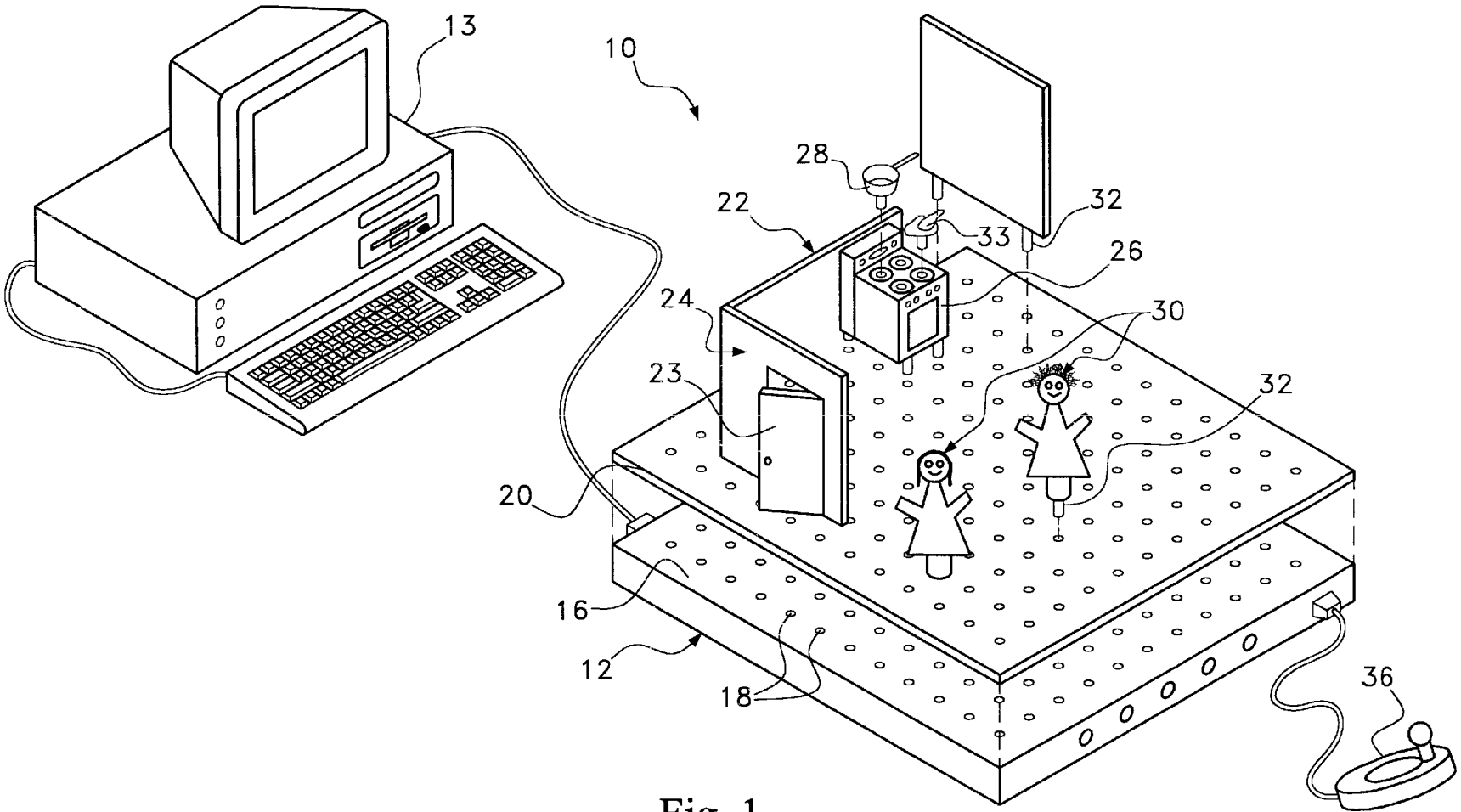
FIG. 1 is a perspective view of one exemplary embodiment of a computer interface device in accordance with the present invention. The embodiment is shown in conjunction with a personal computer and two board game inlays.

Referring to FIG. 1, a first exemplary embodiment of the present invention system 10 is shown. The system 10 includes an interface assembly 12 that enables physical items to be recognized by a personal computer 13 for use in playing a game or performing a structured play activity.

In the embodiment of FIG. 1, the interface assembly 12 is configured to receive components of a doll house. However, such a configuration is merely exemplary. A doll house is a common motif for a child's activity center. Examples of other popular activity center motifs includes farms, airports, city scapes, construction sites and the like. Any such activity center motif can be adapted for used by the present invention.

In the shown embodiment, the interface assembly 12 has a planar top surface 16 upon which is disposed a matrix of holes 18. A board inlay 20 is provided wherein each board inlay 20 is sized to fit across the planar top surface 16 of the interface assembly 12. Graphics are printed on the board inlay 20 that are appropriate for the activity center. For example, in the illustrated embodiment, the interface assembly 12 is being used to create a doll house. The graphics printed on the board inlay 20 therefore would illustrate flooring, carpeting and other items appropriate for this application. However, if selected activity center were a baseball field, the board inlay used on the interface assembly would illustrate a baseball field.

Various play objects are provided for use with the selected game or activity center. As has been stated, the shown illustration is for a doll house activity center. Accordingly, two types of play objects are provided. The first type of play objects provided are prop objects 22. Prop objects 22 include the walls, doors, furniture, appliances and other stationary objects that define the doll house. When placed on the board inlay 20, the prop objects 22 create an activity landscape in which a child can play. Since the prop objects 22 can be placed in countless orientations and combinations, the activity landscape may vary every time a child uses the system 10.

The prop objects 22 may also include activity stations. An activity station is any place in the activity landscape where the activity landscape can be selectively altered by a playing child. For example, a prop object 22 may include a doll house wall having a door 23. The door 23 can be opened and closed by a playing child. The door 23 may also have a doorbell 24 that can be pressed by a child. As such, the door 23 is an activity station. Similarly, a prop object 22 can be a stove 26. The stove 26 has a door that can be opened and closed by a child. The stove 26 also has burners upon which various pots 28 can be placed. As such, within the activity landscape the stove 26 is an activity station.

The second type of play objects provided are action objects 30. The action objects 30 include people, pets, pots, dishes, food and anything else a child may move around the activity center from point to point at different times.

Most of the prop objects 22 and action objects 30 have the ability to be electronically identified by the personal computer 13 through the interface assembly 12. Prop objects 22 and action objects 30 that rest directly upon the board inlay 20 contain pegs 32 that extend through the holes of the board inlay 20 and extend into the interface assembly 12. Once the play objects are received within the interface assembly 12, the location, identity and orientation of the various prop objects 22 and action objects 30 are specifically identified by the computer 13. The manner by which different various play objects can be identified by a computer is the subject of co-pending application Ser. No. 08/858,216, entitled, Computer Interface Apparatus For An Amusement Device, filed May 10, 1997, the disclosure of which is incorporated herein by reference.

The computer 13 contains software that recognizes all of the play objects being used. A play object, such as a wall, is connected to the interface apparatus 12, the identity and location of that play object is identified to the computer. Accordingly, when a doll house wall is added to the interface apparatus 12, the computer 13 recognizes the presence of the wall and modifies its internal understanding of the layout of the activity landscape. The computer 13 may even show that wall in a virtual representation of the activity landscape on the monitor of the computer 13. Similarly, as other prop objects 22, such as furniture and appliances, are added to the interface apparatus 12, the computer 13 modifies its understanding of the activity landscape to match the physical structure of the activity center.

As a child moves the various action objects 30 on the interface assembly 12, the computer 13 tracks the movement of the action objects 30 and recognizes the position of the action objects 30 within the confines of the activity landscape. Accordingly, when a person moves an action object 30 from one point to another, the computer 13 recognizes which object is moved and the new location of that object. The physical change is then stored in the memory of the computer 13.

As has been previously stated, the prop objects 22 may contain activity stations. Activity stations may also be permanently built into the structure of the interface assembly 12 if the interface assembly is dedicated to a single game. In the shown embodiment, the door 23 to the doll house is an activity center. The door 23 has a push button 24 positioned as a door bell. As such, when the door bell is pressed, that physical action can be read by the computer 13 through the interface apparatus 12. Similarly, the hinges on the door 23 may contain an electronic switch. As such, if the door 23 is opened, the movement of the door 23 can be read by the computer 13 through the interface apparatus 12.

Certain prop objects 22 and action objects 30 may also have supplemental input ports designed into their structure. For example, one of the prop objects in the doll house is the stove 26. The stove top may have places to place toy cooking pots 28, which are action objects. The stove top may contain input ports that receive the various different toy pots 28 that come with the doll house. Once a toy pot 28 is placed on the stove 26, the computer 13 can identify the position and type of pot through the stove's interconnection with the below lying interface apparatus 12. Similarly, the doll house may come with different selections of toy food 33 that can be placed in the pots 28 or in the stove 26. Again by providing input ports in the pots 28 and in the stove 26, the toy food 33 used can be identified by the computer 13.

In addition to the play objects, other game controls 36 can be connected to either the interface apparatus 12 or the computer itself. The game controls 36 can be joy sticks, a computer mouse, keyboards or any other game control device. In the shown embodiment, electronic cranks are provided. The cranks are used to input the passage of time into the computer 13. For example, in the shown doll house motif, a child can change the time of day by rotating the crank. In this manner, the game can change from dinner time cooking activities to bed preparation activities.

Through the use of the interface assembly 12, the computer 13 knows the location, orientation and identity of most all of the prop objects 22 and action objects 30 that are being used in play. The computer 13 also knows the status of all activity stations, be those activity stations on a prop object 22 or built into the interface assembly. The computer 13 also receives data input from the various game controllers 36. With this information, the computer 13 does more than monitor the physical layout of the play objects placed on the interface apparatus 12. The computer 13 can interact with a person in the playing of the game. For example, the computer 13 can prompt a person to show them where certain play objects should be placed. The computer 13 can play the part of one of the dolls used in the doll house and can interact with human players by promoting activities such as cooking with the toy stove. If a play object has lights, the computer 13 can selectively light the lights. Preferably, the computer 13 can also generate sounds during the game and during certain games can produce a synthesized voice. For example, if the game is being played and the computer 13 is acting as a player, the computer can audibly read cards or instruct other players in accordance to the rules of the game being played.

In one embodiment of the present invention, the computer 13 can be preprogrammed with various story lines. The computer 13 can interact with a child playing in an activity center to direct play in accordance with the story line. For example, suppose an activity center is set up having a farm motif. A story line could be designed to educate children on how farmers feed the various animals that live on the farm. The computer can prompt a child to perform certain actions within the activity center that achieve the story line. The computer monitors the child's actions to direct and educate the child as the story line progresses.

It will be understood that the shown embodiment of a doll house is merely exemplary. The present invention can be used in many different formats. For example, the doll house motif can easily be changed to a farm motif, a space ship motif, a neighborhood motif or the like. The present invention system can be adapted for use with puzzles, wherein the interface apparatus is a puzzle board that recognizes the position of puzzles objects placed on that board. Furthermore, most any board game can be adapted of use with the present invention system, whereby the board inlay mimics the board of the gameboard and the play objects are all modified to interact with the interface apparatus below the board inlay.

In the shown embodiment, the various play objects had pegs that physically entered the below lying interface apparatus. It is the structure of the pegs that enables the computer to identify the playing object, the location of the playing object and the orientation of the playing object. The use of pegs is also exemplary. The play objects need not have pegs. Rather, play objects can be identified by their magnetic properties, electrical properties, signalling properties, or the like. With such play objects, the underlying interface apparatus need not have holes in its top surface.

The embodiment of FIG. 1 shows an interface apparatus where the top surface of the interface apparatus is flat. This need not be the case. The interface apparatus can be contoured or shaped into a three-dimensional object. For example, the interface apparatus can be shaped as a ship having multiple different levels. Players can then place various play objects on the different levels of the ship, wherein those playing objects can be identified by the computer.

Figure 2:
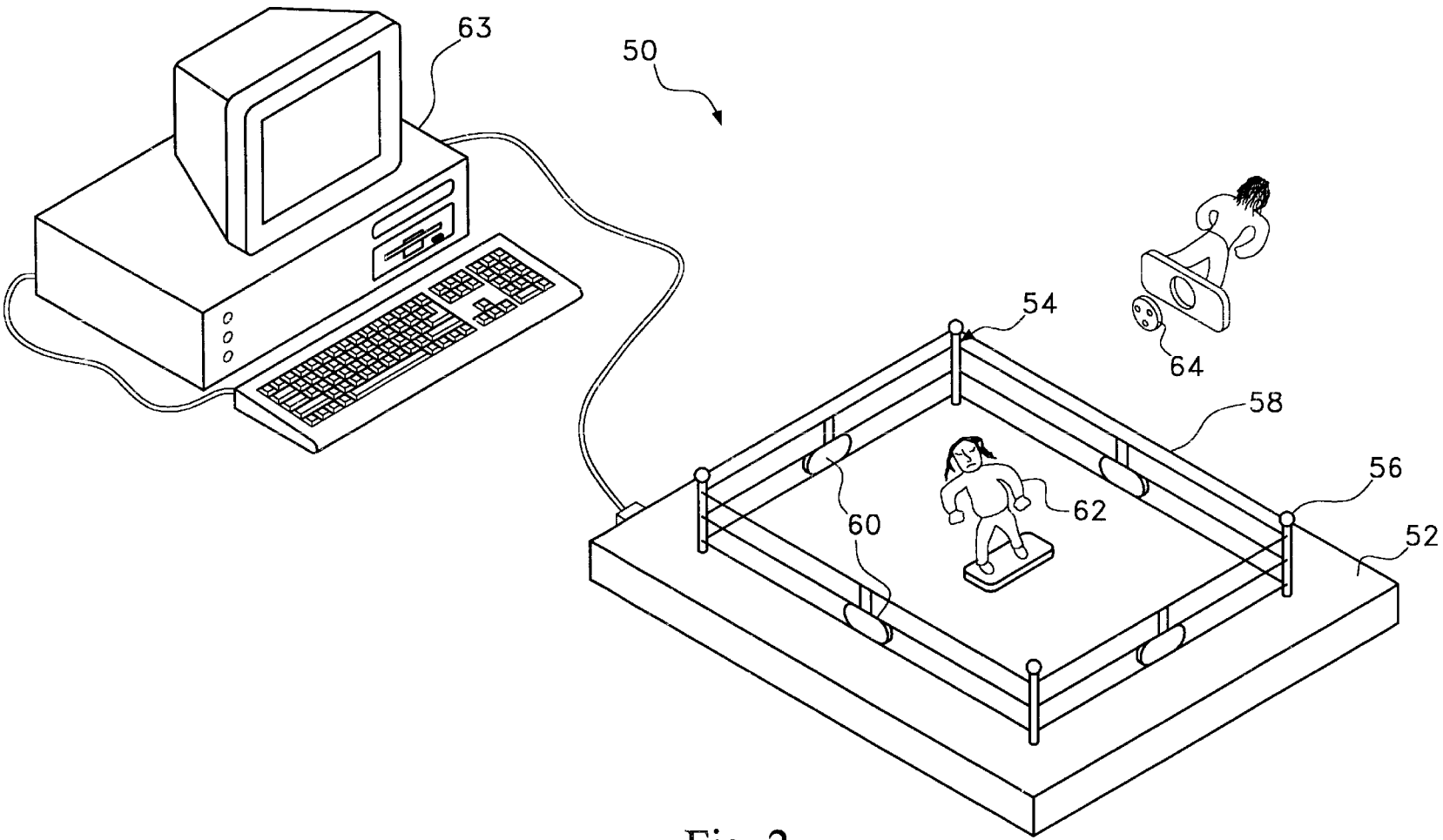
FIG. 2 is a perspective view of a second exemplary embodiment of a computer interface device in accordance with the present invention.

Referring to FIG. 2, there is shown another embodiment of an interface assembly 50 in accordance with the present invention. The interface assembly 50 is embodied as a professional wrestling activity center. However, many other motifs can be used. In the shown embodiment, the interface assembly 50 contains a main play board 52. Within the main board 52 are sensors capable of detecting the presence of a play object and the orientation of that play object. Again the play object can either be a prop object or an action object, as has been previously described.

The manner in which the various play objects are detected is through the use of unique transducers. As the transducers are brought into close proximity with main play board 52 of the interface assembly 50, the transducers create a signal that indicates the identity of the transducer and the orientation of the transducer relative the main play board 52. The technology for use of transducers in game pieces that enable the game piece to be identified electronically has been embodied into multiple electronic chess games, produced by different manufacturers. Any such transducer identification technology can be adapted for use by the present invention.

In the shown embodiment, the interface assembly 50 is embodied as a professional wrestling activity center. The professional wrestling activity center has a ring 54 made of ring posts 56 and simulated rope 58. The ring posts 54 and rope 58 are prop objects. The ring posts 54 may be set in a fixed position. However, transducers 60 are present on the ropes. Accordingly, the interface assembly 50 can detect when one of the ropes 58 moves.

Among the playing objects of the activity center are wrestling FIGS. 62. The wrestling FIGS. 62 can be manufactured with transducers. However, in the shown embodiment, a transducer 64 can be attached to a preexisting wrestling figure. As such, a child who has a collection of various action figures can use those figures as part of the activity center.

If transducers 64 are being added to preexisting figures, the figure associated with a particular transducer is read into the computer 63. Accordingly, the computer 63 is then able to identify the figure when it is used within the activity center.

The interface assembly 50 identifies the location and orientation of all prop objects and action objects. These locations and orientations are read to the computer 63. The computer 63 can therefore monitor play and interact with play by structuring story lines to govern play.

Figure 3:
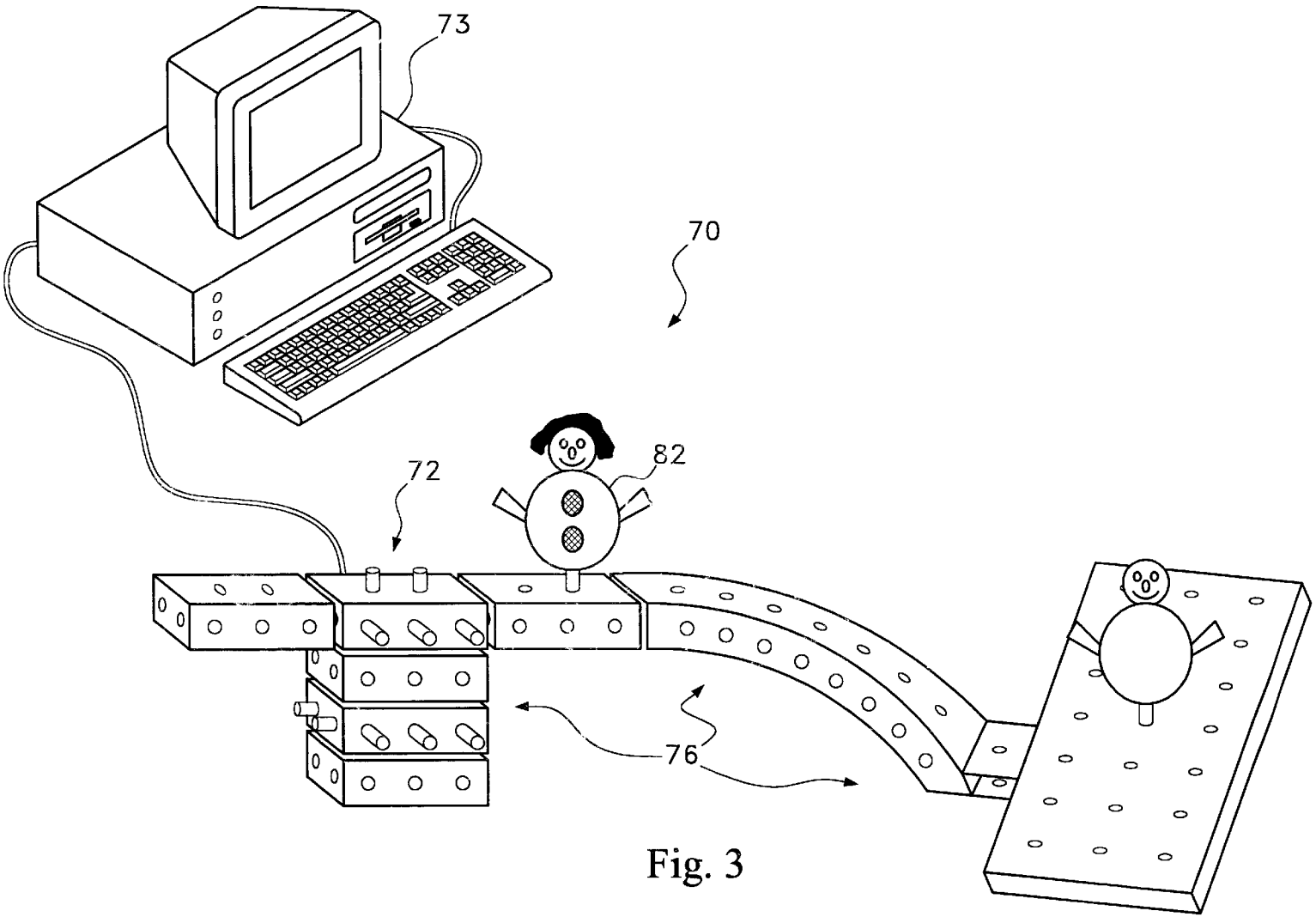
FIG. 3 is a perspective view of a third exemplary embodiment of a computer interface device in accordance with the present invention.

Referring to FIG. 3, there is another embodiment of an interface assembly 70 in accordance with the current invention. The interface assembly 70 is embodied as a construction set activity center. In the shown embodiment, the interface assembly 70 contains a main play board 72 that has circuitry that provides the means to connect extensions 76 which also contain circuitry to allow connection of other extensions 76, forming a constructed play board. The extensions shown are only exemplary, and other types of extensions could be employed.

Play objects are recognized when plugged into the extended play board. Play objects can be either prop object or action objects, as previously described. Two action objects 82 are shown in FIG. 3. When extensions 76 are added to the main play board 72 information is read into the computer 73, which is then able to identify the type of extension added. Likewise, when an action object 82 is plugged into an extension, the computer 73 is able to identify the action object.

It will be understood that the embodiments of the present invention described and illustrated herein are merely exemplary and a person skilled in the art can make many variations to the embodiments shown without departing from the scope of the present invention. It should also be understood that the various elements from the different embodiments shown can be mixed together to create alternate embodiments that are not specifically described. All such variations, modifications and alternate embodiments are intended to be included within the scope of the present invention as defined by the appended claims.

What is claimed is:

1. A system comprising:

a computer;

an interface assembly coupled to said computer, enabling said computer and said interface assembly to bidirectionally exchange signals, said interface assembly having at least one play surface, wherein a plurality of play object identifiers are disposed under said at least one play surface of said interface assembly;

a plurality of prop objects selectively positionable on said at least one play surface of said interface assembly, at least one of said prop objects having an interactive feature that is selectively controlled by signals from said computer that are received through said interface assembly, wherein said prop objects create one of many possible activity landscapes on said interface assembly and said play object identifiers in said interface assembly read the positions of said prop objects, and the activity landscape that is created on said activity landscape, to said computer; and a plurality of action objects selectively positionable on said at least one play surface of said interface assembly within said activity landscape, wherein said play object identifiers in said interface assembly read the positions of said action objects to said computer.

2. The system according to claim 1, wherein said interactive feature of at least one of said prop objects is selected from a group consisting of audible indicators and visual indicators.

3. The system according to claim 1, wherein at least one of said prop objects has a moveable element that is monitored by said computer through said play object identifiers in said interface assembly.

4. The system according to claim 1, wherein at least one of said action objects has a moveable element that is monitored by said computer through said play object identifiers in said interface assembly.

5. The system according to claim 1, wherein said computer is selected from a group consisting of personal computers and dedicated video game computers.

6. The system according to claim 1, wherein at least one of said action objects is positionable on at least one of said prop objects, wherein said computer reads the location of that action object through the prop object it engages and said interface assembly.

7. The system according to claim 1, wherein said computer prompts human players with a story line depending upon said activity landscape and the movement of action objects by the human players within the activity landscape.

8. The system according to claim 1, further including controllers coupled to said interface apparatus, wherein signals generated by said controllers are read by said computer through said interface assembly.

9. The system according to claim 1, wherein each of said action objects is uniquely identifiable and said computer identifies said unique configuration through said interface assembly.

10. The system according to claim 1, wherein each of said prop objects has a unique configuration and said computer identifies said unique configuration through said interface assembly.

11. A computer interface assembly, comprising:

a plurality of play objects;

an activity center having a plurality of places where said play objects can be selectively placed, wherein said activity center contains internal identifiers that read the location of placed play objects in a format readable by a computer;

at least one activity station located on said activity center, wherein said activity station has a changeable configuration readable to a computer through said activity center; and a plurality of prop objects selectively positionable on said activity center, wherein said internal identifiers in said activity center read the location of placed prop objects in a format readable by a computer, and wherein at least one of said prop objects has an interactive feature that is selectively controllable by a computer through said activity center.

12. The assembly according to claim 11, wherein each of said play objects is uniquely identifiable by a computer through said activity center.

13. The system according to claim 11, wherein said interactive feature is selected from a group consisting of audible indicators and visual indicators.

14. The system according to claim 11, wherein said at least one activity station has an interactive feature controllable by a computer through said activity center.

* * * * *